US006060439A

United States Patent [19]

Doyel et al.

[11] Patent Number: 6,060,439

[45] Date of Patent: May 9, 2000

[54] CLEANING COMPOSITIONS AND METHODS FOR CLEANING RESIN AND POLYMERIC MATERIALS USED IN MANUFACTURE

[75] Inventors: Kyle J. Doyel; Michael L. Bixenman; Scotty S. Sengsavang; Kristie L. Gholson; Patricia D. Overstreet; Arthur J. Thompson; Valerie G. Porter, all of Nashville, Tenn.

[73] Assignee: Kyzen Corporation, Nashville, Tenn.

[21] Appl. No.: 08/939,437

[22] Filed: Sep. 29, 1997

[51] Int. Cl.[7] ..... C11D 7/26; C11D 7/28

[52] U.S. Cl. ..... 510/164

[58] Field of Search ..... 510/164

[56] References Cited

U.S. PATENT DOCUMENTS

| | | | |
|---|---|---|---|
| 4,617,251 | 10/1986 | Sizensky | 430/256 |
| 4,737,195 | 4/1988 | Carandang et al. | 134/38 |
| 4,777,119 | 10/1988 | Brault et al. | 430/296 |
| 5,085,698 | 2/1992 | Ma et al. | 106/20 |
| 5,130,393 | 7/1992 | Nakamura | 526/314 |
| 5,139,607 | 8/1992 | Ward et al. | 156/655 |
| 5,563,119 | 10/1996 | Ward | 510/176 |
| 5,736,078 | 4/1998 | Tisack | 264/39 |
| 5,772,790 | 6/1998 | Huber | 134/42 |

FOREIGN PATENT DOCUMENTS

| | | |
|---|---|---|
| 0 853 116 | 7/1998 | European Pat. Off. . |
| WO 94/05766 | 3/1994 | WIPO . |
| WO 94/21773 | 9/1994 | WIPO . |

OTHER PUBLICATIONS

Database WPI, Section Ch, Week 9711, Derwent Publications Ltd., London , GB; Class A32, AN 97–115596, XP002090250 & JP 09 003486 A ( Mitsubishi Chem Corp), Jan. 7, 1997—Abstract.

Database WPI, Section Ch, Week 8216, Derwent Publications Ltd., London , GB; Class A23, AN 82–32176E, XP002090251 & JP 57 045059 A ( Daicel Chem Inds Ltd.), Mar. 13, 1982—Abstract.

*Primary Examiner*—John R. Hardee

*Attorney, Agent, or Firm*—Evenson, McKeown, Edwards & Lenahan, PLLC

[57] ABSTRACT

Compositions and methods for cleaning, solvating, and/or removing plastic resins and polymers or other contaminants from manufactured articles or manufacturing equipment, particularly in the production of optical lenses. The compositions contain at least one nitrogen containing compound as well as other optional solvents and additives. The compositions can be contacted with a surface to be cleaned in a number of ways and under a number of conditions depending on the manufacturing or processing variables present.

27 Claims, No Drawings

CLEANING COMPOSITIONS AND METHODS FOR CLEANING RESIN AND POLYMERIC MATERIALS USED IN MANUFACTURE

BACKGROUND OF THE INVENTION

This invention relates to compositions useful in and methods for cleaning, solvating and/or removing plastic resins and polymers from manufactured articles or manufacturing equipment, such as in the production of optical lenses. More particularly, the invention relates to solvent and solvent mixtures used to remove residues and methods of removing residues of plastic lens resins and polymers from materials that come in contact with the polymers, such as, but not limited to, lenses, molds, holders, racks, tools, and equipment used in the process of manufacturing organic lenses.

In recent years, plastic lenses have seen greater utility in eyeglass and camera lenses as well as in optical devices since they are lighter, dyeable, and more durable than lenses made from inorganic components. Original work focused on developing transparent plastic resins and polymers that possessed these better characteristics and had a refractive index similar to optical glass, which was approximately 1.52. A popular resin discovered for this use, and widely used commercially today, was a material obtained by subjecting diethylene glycol bisallyl carbonate (DEGBAC) (PPG Industries, Inc. Trademark "CR-39") to radical polymerization. This resin had various positive attributes of impact resistance, light weight, dyeability, and good machinability in cutting, grinding and polishing processes. The resin was found to have a refractive index of 1.50, which was lower than the refractive index for inorganic lenses, around 1.52.

To achieve optical equivalence to the inorganic glass lenses, it was necessary to increase the central and peripheral thickness along with the curvature of the lens. This increased thickness was undesired among users of optical lenses despite the obvious positive benefits of the organic resin lens. Therefore, newer resins and polymeric materials have and will be developed containing higher refractive indexes that will result in thinner and lighter lenses.

As a method for increasing the refractive index of plastic lenses, there are known methods comprising copolymerizing a monomer mixture by adding to a conventional monomer another monomer, which imparts a higher refractive index to the resulting polymer. The higher refractive index polymer and plastic lens obtained is required to not only have a high refractive index (>1.49), but also exhibit good physical, mechanical and chemical properties as an optical lens. The art of manufacture of optical lenses from plastics involves the use of a number of polymers and copolymers of acrylates, methacrylates, methyl methacrylates, polycarbonates, phthalates, isocyanates, polyethers, urethanes and other monomer structures, that are well known and documented. Recent monomer art has included the use of a halogen molecule such as chlorine or bromine which will contribute to increasing the refractive index.

The lens and polymer industry continues to evolve as work continues on developing higher refractive index materials. Recent work has involved the use of sulfur as a part of the polymer. Adding sulfur to the polymer matrix greatly increases the refractive index of the polymer in addition to maintaining the desirable physical and optical characteristics. The addition of sulfur also increases the chemical resistance of the polymer making it more difficult to clean the apparatus used to manufacture the optical lens.

The method of producing a plastic lens is well documented. The lens is produced by a method in which a monomer mixture is cast into a casting mold formed of a glass, metal or plastic mold piece and a gasket made from an elastomer (typically ethylene-vinyl acetate copolymer) or metal. The polymer may contain an additive, which aids in initiating, controlling and polymerizing the monomers. The mold is then heated to a predetermined temperature for a predetermined period of time, and may or may not be irradiated by ultraviolet light, for instance, or subject to chemical treatments that assist in initiating or controlling the polymerization of the plastic lens in a desirable manner. The process continues for a predetermined period of time until the desired level of polymerization is achieved. The lens is then usually taken out of the mold by separating the mold pieces and gaskets and then subjected to further processing.

The mold pieces and gaskets are usually very expensive items that require cleaning prior to reuse. Often the mold pieces will be contaminated with polymer which has overflowed to the external sides of the mold, thereby requiring cleaning. In addition this overflowed polymer will be found on the holders, racks, tooling, and any other apparatus or equipment used in the manufacturing process that comes in contact with the polymer. Because the design of the optical polymer attempts to ensure a lens product with tough physical characteristics and chemical resistance, any overflowed polymer will likewise also display these characteristics. Therefore, the removal of the overflowed material from equipment is very difficult and can be very costly if the cleaning technique used damages the tooling or equipment.

Current art employs a number of methods to remove the polymer, which fall into three general methods. The first method is mechanical, where the polymer is removed from desired equipment, tooling, and molds by physical means of scraping and sandblasting. This method has drawbacks in that it is labor intensive, messy, time consuming, and many times can damage the delicate molds and equipment. The second method is thermal, in which the polymer is burned off in ovens or by heated media such as sand. This method is undesirable because of the cost of energy, the volatile organic compounds it produces, and the potential for fire. In addition, the elevated temperature required to clean some of the parts may physically affect the part and render them useless. The third method is chemical in which the molds, tooling, and/or equipment is contacted with a chemical solution that allows the polymer to be removed. This method is desirable since it is usually more cost effective in labor and time than the other two methods.

Chemical cleaning methods for removal of undesired or overflowed polymer falls into the use of strong inorganic acids or alkali. Most commonly used in the art are strong inorganic acids, such as sulfuric, nitric, or hydrochloric acid. The oxidizing action of these acids is most effective at elevated temperatures and they are, therefore, used mainly at temperatures in excess of 140° F. (60° C.) in order to remove most of the undesired polymers. The drawback of the use of these acids is that they are hazardous materials, and can be very aggressive on most molds and equipment, thereby reducing the useful life.

In most instances, special equipment, handling, and special rooms are required to operate the cleaning process. The use of alkali, such as alkali metal hydroxides such as sodium and potassium hydroxide, have also been found in the art. Like strong acids, these materials will have similar limitations and drawbacks, and seem likewise to only be effective in high concentrations at high temperatures. In high concentrations, these materials have a negative impact on glass molds and can be costly in reducing the useful life of the mold. U.S. Pat. No. 5,130,393 discusses the use of a combination of methylene chloride and strong alkali for cleaning molds and also for assisting in releasing the lens from the mold. No reference was made to the conditions and/or concentrations used in cleaning, nor was any mention made as to the effectiveness with polymers that contain sulfur and or halogens.

SUMMARY OF THE INVENTION

The present invention overcomes the problems and disadvantages that currently exist by providing a cleaning mixture and process for cleaning efficiently, which exhibits superior properties or results over the previous methods. It is an object of the invention to provide an efficient, cost-effective process for cleaning a broad range of polymers and resins used in manufacture of optical organic lenses, which may also be suitable for use on an industrial scale.

The present invention relates to solvent and solvent mixtures and methods of removing residues of plastic lens resins and polymers from materials that come in contact with the polymers and/or resins such as, but not limited to, lenses, molds, holders, racks, tooling devices and equipment used in the process of manufacturing organic lenses.

In one aspect, the invention relates to novel cleaning compositions containing at least one nitrogen containing compound and having a pH of about 7 or greater. The preferred compounds of the cleaning compositions are nitrogen containing compounds that also contain one hydroxyl group. Other beneficial materials that can be added are one or more of the following materials: water; alcohols; inorganic hydroxides; esters; ethers; cyclic ethers; ketones; alkanes; terpenes; dibasic esters; glycol ethers; pyrrolidones; or low or non-ozone depleting chlorinated and chlorinated/fluorinated hydrocarbons. The compositions may also be enhanced by one skilled in the art by adding buffering agents, surfactants, chelating agents, colorants, dyes, fragrances, indicators, inhibitors, and other ingredients to modify the properties.

More specifically, the cleaning composition of the invention generally has a pH greater than 7.0, and contains an effective amount of the following compound:

$$N_xC_yH_zO_a \qquad \text{(Formula I)}$$

where x=1 to 2, y=0 to 30, z=3 to 63, and a=0 to 4. Examples of these nitrogen containing compounds are amines, diamines, alkanolamines, quaternary ammonium hydroxides, ammonium hydroxide, and ammonia.

Preferred compositions and methods to clean polymers and resins in accordance with this invention contain an effective amount of at least one quaternary ammonium hydroxide of the formula:

(Formula II)

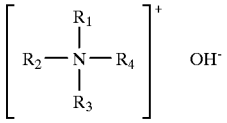

wherein $R_1$, $R_2$, $R_3$ and $R_4$ are each, independently, an alkyl group containing from 1 to about 10 carbon atoms, aryl group, alkoxy group containing 1 to about 10 carbon atoms, or $R_1$ and $R_2$ are each an alkylene group joined together with the nitrogen atom to form an aromatic or non-aromatic heterocyclic ring, provided that if the heterocyclic group contains a —C═N— bond, $R_3$ is the second bond.

In preferred embodiments, $R_1$, $R_2$, $R_3$ and $R_4$ are each, independently, alkyl groups containing from 1 to about 10 carbon atoms and, in a more preferred embodiment, the alkyl groups contain from 1 to 4 carbon atoms. Specific examples of alkyl groups containing from 1 to about 10 carbon atoms include methyl, ethyl, propyl, butyl, pentyl, hexyl, heptyl, octyl, nonyl, and decyl groups. Examples of various aryl groups include phenyl, benzyl, and equivalent groups.

Examples of specific preferred quaternary ammonium hydroxides, which can be used in the method of the invention, include tetramethylammonium hydroxide, tetraethylammonium hydroxide, tetrapropylammonium hydroxide, trimethylethylammonium hydroxide, methyltriethylammonium hydroxide, dimethyldiethylammonium hydroxide, methyltributylammonium hydroxide, methyl tripropylammonium hydroxide, tetrabutylammonium hydroxide, phenyltrimethylammonium hydroxide, phenyltriethylammonium hydroxide, and benzyltrimethylammonium hydroxide. Most preferred is tetramethylammonium hydroxide, tetrabutylammonium hydroxide, and tetraethylammonium hydroxide.

In another preferred embodiment, $R_1$, $R_2$, $R_3$ and $R_4$ in Formula II are each, independently, alkoxy and/or alkyl groups containing from 1 to about 10 carbon atoms and, in a more preferred embodiment, the alkoxy/alkyl groups contain from 1 to 4 carbon atoms. Specific examples of alkyl/alkoxy groups containing from one to 10 carbon atoms include methyl/methoxy, ethyl/ethoxy, propyl/propoxy, butyl/butoxy, pentyl/pentoxy, hexyl/hexoxy, heptyl/heptoxy, octyl/octoxy, nonyl/nonoxy, and decyl/decoxy groups.

Examples of specific quaternary ammonium hydroxides, which can be used in the method of the invention, include trimethyl-2-hydroxyethyl ammonium hydroxide (choline), trimethyl-3-hydroxypropyl ammonium hydroxide, trimethyl-3-hydroxybutyl ammonium hydroxide, trimethyl-4-hydroxybutyl ammonium hydroxide, triethyl-2-hydroxyethyl ammonium hydroxide, tripropyl-2-hydroxyethyl ammonium hydroxide, tributyl-2-hydroxyethyl ammonium hydroxide, dimethylethyl-2-hydroxyethyl ammonium hydroxide, dimethyldi(2-hydroxyethyl) ammonium hydroxide, and monomethyltri(2-hydroxyethyl) ammonium hydroxide.

The quaternary ammonium hydroxides useful in the invention may include cyclic quaternary ammonium hydroxides. By "cyclic quaternary ammonium hydroxide" is meant compounds in which the quaternary substituted nitrogen atom is a member of a non-aromatic ring of between 2 and about 8 atoms or an aromatic ring of from 5 or 6 atoms in the ring. That is, in Formula II, $R_1$ and $R_2$ together with the nitrogen atom form an aromatic or non-aromatic heterocyclic ring. If the heterocyclic ring contains a —C═N— bond (e.g., the heterocyclic ring is an unsaturated or aromatic ring), then $R_3$ in Formula II is the second bond.

The quaternary nitrogen-containing ring optionally includes additional heteroatoms such as sulfur, oxygen or nitrogen. The quaternary nitrogen-containing ring may also be one ring of a bicyclic or tricyclic compound. The quaternary nitrogen atom is substituted by one or two alkyl groups depending on whether the ring is aromatic or non-aromatic, and the two groups may be the same or different. The alkyl groups attached to the nitrogen are preferably alkyl groups containing from 1 to 4 carbon atoms and more preferably methyl. The remaining members of the quaternary nitrogen ring may also be substituted if desired. Cyclic quaternary ammonium hydroxides useful in the process of the present invention may be represented by the following formula:

(Formula III)

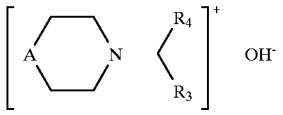

wherein $R_3$ and $R_4$ are each independently alkyl groups containing from 1 to 10 carbon atoms, preferably 1 to 4 carbon atoms, and more preferably methyl, and A is an oxygen, sulfur or nitrogen atom. When the heterocyclic ring is an aromatic ring (i.e., a —C═N— bond is present), $R_3$ is the second bond on the nitrogen.

Cyclic quaternary ammonium hydroxides can be prepared by techniques well known to those skilled in the art. Examples of these hydroxides include: N,N-dimethyl-N'-methyl pyrizinium hydroxide; N,N-dimethylmorpholinium hydroxide; and N-methyl-N'-methyl imidazolinium hydroxide. Other cyclic quaternary ammonium hydroxides may be prepared from other heterocyclic compounds such as pyridine, pyrrole, pyrazole, triazole, oxazole, thiazole, pyridazine, pyrimidine, anthranil, benzoxazole, quinazoline, etc., or derivatives thereof. When a solution of the quaternary ammonium hydroxides as described above is used, most commercial sources of these compounds are aqueous and may contain from about 0.1 to about 60% by weight or more of the quaternary ammonium hydroxide.

In this embodiment, the solution may comprise from about 0.01 to about 100% by weight of the aqueous quaternary ammonium hydroxide, or from about 0.01 to about 60% by weight of the neat quaternary ammonium hydroxide. Aqueous solutions of the quaternary ammonium hydroxides are presently preferred in the practice of the method of the present invention.

Other useful nitrogen containing compositions used to clean the optical polymers or resins in accordance with this invention comprise at least one nitrogen containing compound of the formula:

(Formula IV)

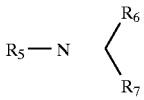

wherein $R_5$, $R_6$, and $R_7$ are each independently hydrogen, hydroxyl, an alkyl group containing from 1 to about 10 carbon atoms, an aryl group, an amine group containing from 1 to about 10 carbon atoms, or an alkoxy group containing 1 to about 10 carbon atoms.

In a preferred embodiment, $R_5$, $R_6$, are hydrogen and $R_7$ is alkyl, alkoxy or amine groups containing from 1 to about 10 carbon atoms and, in a more preferred embodiment, the alkyl or alkoxy or amine groups contain from 1 to 6 carbon atoms.

Examples of specific nitrogen containing compounds, which can be used in the process of the present invention, include ammonia, hydroxylamine, methylamine, dimethylamine, trimethylamine, ethylamine, diethylamine, triethylamine, monoethanolamine, diethanolamine, triethanolamine, 1-amino-2-propanol, 1-amino-3-propanol, 2-(2-aminoethoxy) ethanol, 2-(2-aminoethylamino) ethanol, 2-(2-aminoethylamino) ethylamine, ethylenediamine, hexamethyldiamine, 1,3 pentanediamine, n-isopropylhydroxylamine, 2-methylpentamethylenediamine, and the like, and other strong nitrogen containing organic bases such as guanidine. Most preferred are monoethanolamine, diethanolamine, triethanolamine, 1-amino-2-propanol, ethylenediamine, hexamethyldiamine, 1,3 pentanediamine, n-isopropylhydroxylamine, and 2-methyl, pentamethylenediamine.

The nitrogen containing compounds useful to clean the optical polymers and resins in accordance with this invention are soluble in various solvents, such as water, alcohols, aqueous inorganic hydroxides, esters, ethers, cyclic ethers, ketones, alkanes, terpenes, dibasic esters, glycol ethers, pyrrolidones, or low or non-ozone depleting chlorinated and chlorinated/fluorinated hydrocarbons. Thus, the composition or mixture utilized in the process of the invention, and which comprises one or more of the above-described nitrogen containing compounds, may be dissolved in any one or more of the before-mentioned solvents as an additional component of the cleaning composition. The detailed description below provides a non-limiting disclosure of the additional components that may be selected. The compositions of the invention, thus, may also include one or more of the above-mentioned solvents. Aqueous solutions of the quaternary ammonium hydroxides, organic amines and alkanolamines are preferred in the practice of the invention, but other solvents may be used in conjunction with them. The form the compositions are in when used for cleaning may vary from liquid at various temperatures, to vapor, to aerosol, or other dispersions appropriate for the components of the composition selected. Buffers, corrosion inhibitors and other additives may also be included in the cleaning compositions of the invention.

The polymer to be removed from a surface or cleaned by this invention can be any polymeric substance that is used in the manufacture of optical products that has a refractive index greater than 1.49. In industrial practice, the most common is a polymeric material obtained by subjecting diethylene glycol bisallyl carbonate (DEGBAC) (PPG Industries, Inc. Trademark "CR-39") to radical polymerization. This material may be copolymerized with any number of other monomers including but not limited to acrylates, methacrylates, methyl methacrylates, polycarbonates, phthalates, isocyanates, polyethers, urethanes.

Other popular polymers or resins that can be cleaned from or removed from manufacturing parts or manufactures articles by this invention include any acrylate, methacrylate, methyl methacrylate, polyester, polystyrene, polycarbonate, phthalate, isocyanate, polyether, urethane, thio or sulfur containing polymers, and halo or chlorine and/or bromine containing polymers.

Specific examples of parts or articles cleaned by the process or compositions of this invention include lenses, molds, gaskets, holders, racks, tooling and equipment used in the process of manufacturing lenses made of one or more organic compounds. Contacting a cleaning composition to an article may be through a conventional process or means known in the art that includes but is not limited to those employing: wiping; spraying; immersing; high pressure spray agitation; ultrasonic agitation; vapor degreasing; and soaking. The equipment to perform these processes are known in the art or can be devised from other fields where applying a composition to a solid surface is involved. The process may be conducted at ambient conditions and temperature or up to the boiling point of the selected cleaning composition. Generally, temperature ranges from about 32° F. (0° C.) to about 212° F. (100° C.) are used. The temperature used may also be determined by the selection of the manner of contacting the cleaning composition to the surface to be cleaned. The process is most commonly conducted at atmospheric pressure, but may be conducted at elevated pressure, in a vacuum, or at lower than atmospheric pressure conditions.

The part or article is contacted with the desired cleaning composition for an adequate period of time in order to essentially remove the contaminant or remove the desired amount of the contaminant. The part or article can also be called a "surface" that is to be cleaned. It is not necessary for every detectable trace of a contaminant to be removed from the surface. The contaminant may be a resin or polymer from manufacturing, present in an amount ranging from a residue to a clearly visible amount. The contaminant may also be oils, grease, or other compositions that come into contact with a manufacturing part, the manufactured article, or the surface to be cleaned.

It may, in most instances, be necessary or desirable to rinse the cleaning composition from the part or article with water or with one of the solvents listed above, or with any combination of water and solvents. One skilled in the art can devise numerous combinations of cleaning compositions and rinsing solutions from this disclosure and the known properties of the chemicals used. In addition, one skilled in the art can devise simple tests to determine the appropriate rinsing conditions for a cleaning composition selected. It is common in the art to select a rinsing solution that will effectively remove all of the cleaning agent or composition and allow the rinsing solution to dry from the part either through the use of moving air, heated air and/or natural evaporation. Compounds that affect the odor of a surface being cleaned, that inhibit the corrosion of the surface, that act as a surfactant can also be added to the cleaning compositions or rinsing solutions and used in the cleaning methods.

DETAILED DESCRIPTION OF PREFERRED EMBODIMENTS

In accordance with the invention, novel compositions have been used to clean manufacturing parts or manufactured articles having contaminating polymers or resins. The compositions of the invention comprise at least one nitrogen containing compound and have a pH of 7.0 or greater. The preferred materials of the disclosure are nitrogen containing compounds that also contain one hydroxyl group. The summary above discloses Formulae I–IV and the general structure of the nitrogen containing compound of the compositions and methods of the invention.

Other materials that can be added to make a mixture as the composition and/or used in the method of the invention are one or more of the following materials: water; alcohols; inorganic hydroxides; esters; ethers; cyclic ethers; ketones; alkanes; terpenes; dibasic esters; glycol ethers; pyrrolidones; or low or non-ozone depleting chlorinated and chlorinated/fluorinated hydrocarbons. The resulting mixture may also be enhanced by one skilled at the art by the addition of buffering agents, surfactants, chelating agents, colorants, dyes, fragrances, indicators, inhibitors, and other ingredients to modify the properties of the mixture.

Preferably, the alcohol component of the mixture disclosed above contains an effective amount of the alcohol material of the formula $C_xH_y(OH)_z$ where x=1 to 18, y<2x+2 and z=1 or 2. Examples of these alcohols are methanol, ethanol, propanol, isopropanol, butanol, 2-butanol, tert butyl alcohol, 1-pentanol, 2-pentanol, 3-pentanol, methyl propanol, methyl butanol, trifluoroethanol, allyl alcohol, 1-hexanol, 2-hexanol, 3-hexanol, 2-ethyl hexanol, 1-pentanol, 1-octanol, 1-decanol, 1-dodecanol, cyclohexanol, cyclopentanol, benzyl alcohol, furfuryl alcohol, tetrahydrofurfuryl alcohol, bis-hydroxymethyl tetrahydrofuran, ethylene glycol, propylene glycol, and butylene glycol. They can usable either singly or in the form of a mixture of two or more of them. In the composition listed x can be a number 1 to 12, preferably 1 to 8, more preferably 1 to 6. Among the most preferred are methanol, ethanol, isopropanol, tetrahydrofurfuryl alcohol and benzyl alcohol.

Preferably, the inorganic hydroxide component of the mixture disclosed above contains an effective amount of the inorganic hydroxide based on alkali metal hydroxides. Examples of these are sodium hydroxide, potassium hydroxide and lithium hydroxide. They can be used singly or in the form of a mixture of two or more of them. Among the most preferred are sodium and potassium hydroxide.

Preferably, the ester component of the mixture disclosed above contains an effective amount of the ester material of the formula $R_1$—COO—$R_2$ where $R_1$ is $C_1$–$C_{20}$ alkyl, $C_5$–$C_6$ cycloalkyl, benzyl, furanyl or tetrahydrofuranyl, $R_2$ is hydrogen, $C_1$–$C_8$ alkyl, $C_5$–$C_6$ cycloalkyl, benzyl, phenyl, furanyl or tetrahydrofuranyl. Examples of these esters are methyl formate, methyl acetate, methyl propionate, methyl butyrate, ethyl formate, ethyl acetate, ethyl propionate, ethyl butyrate, propyl formate, propyl acetate, propyl propionate, propyl butyrate, butyl formate, butyl acetate, butyl propionate, butyl butyrate, methyl soyate, isopropyl myristate, propyl myristate, and butyl myristate. In the composition listed $R_1$,$R_2$ can be a number $C_1$ to $C_{20}$ alkyl, preferably $C_1$ to $C_8$, more preferably $C_2$ to $C_6$ or hydrogen. Among the most preferred are methyl acetate, ethyl acetate and amyl acetate.

Preferably, the ether component of the mixture disclosed above contain effective amounts of the ether material of the formula $R_3$—O—$R_4$ where $R_3$ is $C_1$–$C_{10}$ alkyl or alkynl, $C_5$–$C_6$ cycloalkyl, benzyl, phenyl, furanyl or tetrahydrofuranyl, $R_4$ is $C_1$–$C_{10}$ alkyl or alkenyl, $C_5$–$C_6$ cycloalkyl, benzyl, phenyl, furanyl or tetrahydrofuranyl. Examples of these ethers are ethyl ether, methyl ether, propyl ether, isopropyl ether, butyl ether, methyl tert butyl ether, ethyl tert butyl ether, vinyl ether, allyl ether and anisole. In the composition listed $R_3$,$R_4$ can be a number $C_1$ to $C_{10}$ alkyl or alkenyl, preferably $C_1$ to $C_6$ alkyl or alkynl, more preferably $C_1$ to $C_4$ alkyl. Among the most preferred are isopropyl ether and propyl ether.

Preferably, the cyclic ether component of the mixture disclosed above contain effective amounts of the cyclic ether. The preferred materials for cyclic ethers are: 1,4 dioxane, 1,3 dioxolane tetrahydrofuran (THF), methyl THF, dimethyl THF and tetrahydropyran (THP), methyl THP, dimethyl THP ethylene oxide, propylene oxide, butylene oxide, amyl oxide, and isoamyl oxide. Among the most preferred is 1,3 dioxolane and tetrahydrofuran.

Preferably, the ketone component of the mixture disclosed above contains an effective amount of the ketone material of the formula: $R_5$—C═O—$R_6$ where $R_5$ is $C_1$–$C_{10}$ alkyl, $C_5$–$C_6$ cycloalkyl, benzyl, furanyl or tetrahydrofuranyl, $R_6$ is $C_1$–$C_{10}$ alkyl, $C_5$–$C_6$ cycloalkyl, benzyl, phenyl, furanyl or tetrahydrofuranyl. Examples of these ketones are acetone, methyl ethyl ketone, 2-pentanone, 3-pentanone, 2-hexanone, 3-hexanone, and methyl isobutyl ketone. In the composition listed $R_5R_6$ can be a number $C_1$ to $C_{10}$ alkyl, preferably $C_1$ to $C_6$ alkyl or alkynl, more preferably $C_1$ to $C_4$ alkyl. Among the most preferred are acetone, methyl ethyl ketone, 3-pentanone and methyl isobutyl ketone.

Preferably, the alkane component of the mixture disclosed above contain effective amounts of the alkane material of the formula: $C_nH_{n+2}$ where n=1–20, or $C_4$–$C_{20}$ cycloalkanes. Examples of these alkanes are methane, ethane, propane, butane, methyl propane, pentane, isopentane, methyl butane, cyclopentane, hexane, cyclohexane, dimethylcyclohexane, ethylcyclohexane, isohexane, heptane, methyl pentane, dimethyl butane, octane, nonane and decane. In the composition listed x can be a number 1 to 20, preferably 4 to 9, more preferably 5 to 7. Among the most preferred are cyclopentane, cyclohexane, dimethylcyclohexane, ethylcyclohexane, hexane, methyl pentane, and dimethyl butane.

Preferably, the terpene component of the mixture disclosed above contain effective amounts of the terpene material containing at least 1 isoprene group of the general structure:

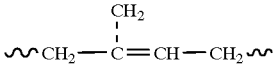

The molecule may be cyclic or multicyclic. Preferred examples are d-limonene, pinene, terpinol, terpentine and dipentene.

Preferably, the dibasic ester component of the mixture disclosed above contain effective amounts of the dibasic ester material of the formula: $R_7$—COO—$R_8$—COO—$R_9$ where $R_7$ is $C_1$–$C_{20}$ alkyl, $C_5$–$C_6$ cycloalkyl, benzyl, furanyl or tetrahydrofuranyl, $R_8$ is $C_1$–$C_{20}$ alkyl, $C_5$–$C_6$ cycloalkyl, benzyl, phenyl, furanyl or tetrahydrofuranyl, $R_9$ is $C_1$–$C_{20}$ alkyl, $C_5$–$C_6$ cycloalkyl, benzyl, furanyl or tetrahydrofuranyl. Examples of these dibasic esters are dimethyl oxalate, dimethyl malonate, dimethyl succinate, dimethyl glutarate, dimethyl adipate, methyl ethyl succinate, methyl ethyl adipate, diethyl succinate, diethyl adipate. In the composition listed $R_7$, $R_8$ and $R_9$ can be a number $C_1$ to $C_{10}$ alkyl, preferably $C_1$ to $C_6$ alkyl or alkynl, more preferably $C_1$ to $C_4$ alkyl. Among the most preferred are dimethyl succinate, and dimethyl adipate.

Preferably, the glycol ether component of the mixture disclosed above contain effective amounts of the glycol ether material of the formula: $R_{10}$—O—$R_{11}$—O—$R_{12}$ where $R_{10}$ is $C_2$–$C_{20}$ alkyl, $C_5$–$C_6$ cycloalkyl, benzyl, furanyl or tetrahydrofuranyl, $R_{11}$ is $C_1$–$C_{20}$ alkyl, $C_5$–$C_6$ cycloalkyl, benzyl, phenyl, furanyl or tetrahydrofuranyl, $R_{12}$ is hydrogen or an alcohol selected from claim 7 above. Examples of these glycol ethers are ethylene glycol methyl ether, diethylene glycol methyl ether, ethylene glycol ethyl ether, diethylene glycol ethyl ether, ethylene glycol propyl ether, diethylene glycol propyl ether, ethylene glycol butyl ether, diethylene glycol butyl ether, methyl methoxybutanol, propylene glycol methyl ether, dipropylene glycol, dipropylene glycol methyl ether, propylene glycol propyl ether, dipropylene glycol propyl ether, propylene glycol butyl ether, and dipropylene glycol butyl ether. In the composition listed $R_{10}$, $R_{11}$ and $R_{12}$ can be a number $C_1$ to $C_{10}$ alkyl, preferably $C_1$ to $C_6$ alkyl, more preferably $C_1$ to $C_4$ alkyl. Among the most preferred are propylene glycol butyl ether, dipropylene glycol methyl ether, dipropylene glycol, methyl methoxy butanol and diethylene glycol butyl ether.

Preferably, the pyrrolidone component of the mixture disclosed above contains an effective amount of the pyrrolidone material that is substituted in the N position of the pyrrolidone ring of the formula: hydrogen, $C_1$ to $C_6$ alkyl, or $C_1$ to $C_6$ alkanol. Examples of these pyrrolidones are pyrrolidone, N-methyl pyrrolidone, N-ethyl pyrrolidone, N-propyl pyrrolidone, N-hydroxymethyl pyrrolidone, N-hydroxyethyl pyrrolidone, and N-hexyl pyrrolidone. Among the most preferred are N-methyl pyrrolidone and N-ethyl pyrrolidone.

Preferably, the chlorinated hydrocarbon component of the mixture disclosed above contain effective amounts of the chlorinated hydrocarbon material of the formula: for alkanes are of the form: $R_{13}$—$Cl_x$ where $R_{13}$ is $C_1$–$C_{20}$ alkyl, $C_4$–$C_{10}$ cycloalkyl, $C_2$–$C_{20}$ alkenyl benzyl, phenyl, and X>1, and the Ozone Depletion Potential (ODP) of the molecule <0.15. Examples of these chlorinated materials are methyl chloride, methylene chloride, ethyl chloride, dichloro ethane, dichloro ethylene, propyl chloride, isopropyl chloride, propyl dichloride, butyl chloride, isobutyl chloride, sec-butyl chloride, tert-butyl chloride, pentyl chloride, and hexyl chloride.

The content of the additional components in the mixture of the present invention is not particularly limited, but for the addition of an effective amount necessary to improve or control solubility, volatility, boiling point, flammability, surface tension, viscosity, reactivity, and material compatibility. The mixture may also be enhanced by one skilled at the art by the addition of buffering agents, surfactants, chelating agents, colorants, dyes, fragrances, indicators, inhibitors, and other ingredients.

Any compound or mixture of compounds suitable for reducing the pH of the nitrogen based cleaner solutions of this invention, and which do not unduly adversely inhibit the cleaning action thereof or interfere with the resulting cleaned parts, may be employed. As examples of such compounds are, for example, acids, bases and their salts acting as buffers, such as inorganic mineral acids and their salts, weak organic acids having a pKa of greater than 2 and their salts, ammonium salts, and buffer systems such as weak acids and their conjugate bases, for example, acetic acid and ammonium acetate. Preferred for use as such components are acetic acid, boric acid, citric acid potassium biphthalate, mixtures of ammonium chloride and ammonium acetate, especially a 1:1 mixture of these two salts, and mixtures of acetic acid and ammonia and other amines.

The following examples are illustrative of the present invention and are not meant to, and should not be taken to, limit the scope of the invention.

EXAMPLE 1

An optical mold is selected that has been contaminated with a diethylene glycol bisallyl carbonate (DEGBAC) based monomer. The polymer is hardened on the external side of the mold and the mold is further contaminated with fingerprint oils and dirt. The contaminated mold is immersed in a solution of 2.5% tetramethyl-ammonium hydroxide, 15% potassium hydroxide, 15% sodium hydroxide and 67.5% water at 150 to 160° F. (ca 65° to ca. 71° C.) for 10 minutes. The mold is removed from the solution, rinsed with water and allowed to air dry. Upon visual inspection the contaminants were observed to be removed.

EXAMPLE 2

An optical mold is selected that has been contaminated with a diethylene glycol bisallyl carbonate (DEGBAC) based monomer. The polymer is hardened on the external side of the mold and the mold is further contaminated with fingerprint oils and dirt. The contaminated mold is immersed in a solution of 3.75% tetramethyl-ammonium hydroxide, 15% potassium hydroxide, 15% sodium hydroxide and 66.25% water at 180 to 185° F. (ca. 82 to 85° C.) for 2 minutes. The mold is removed from the solution, rinsed with water and allowed to air dry. Upon visual inspection the contaminants were observed to be removed.

EXAMPLE 3

35 optical molds are selected for cleaning that have been contaminated with a polyurethane based monomer that contains a sulfur molecule (thioether). The polymer is hardened on the external side of the mold and the mold is further contaminated with fingerprint oils and dirt. The contaminated molds are immersed in series into a solution of 3.75% tetramethylammonium hydroxide, 15% potassium hydroxide, 15% sodium hydroxide and 66.25% water at 180 to 185° F. (ca. 82 to 85° C.) for 2 minutes. Each mold is removed from the solution, rinsed with water and/or methanol and allowed to air dry. Upon visual inspection greater than 98% of the contaminants were observed to be removed from 33 of the 35 molds and all 35 molds had greater than 95% contaminant removal within the 2 minute cleaning time.

EXAMPLE 4

An optical mold is selected that has been contaminated with a diethylene glycol bisallyl carbonate (DEGBAC) based monomer. The polymer is hardened on the external side of the mold and the mold is further contaminated with fingerprint oils and dirt. The contaminated mold is immersed in a solution of 15% monoethanolamine, 13% potassium hydroxide, 13% sodium hydroxide and 59% water at 180 to 185° F. (ca. 82 to 85° C.) for 2.5 minutes. The mold is removed from the solution, rinsed with water and allowed to air dry. Upon visual inspection the contaminants were observed to be removed.

EXAMPLE 5

An optical mold is selected that has been contaminated with a polyurethane based monomer that contains a sulfur molecule (thioether). The polymer is hardened on the external side of the mold and the mold is further contaminated with fingerprint oils and dirt. The contaminated mold is immersed in a solution of 17.8% tetramethyl ammonium hydroxide, 3.8% surfactant and 78.4% water at 140° F. (60° C.) for 5 minutes, 160° F. (ca. 71° C.) for 5 minutes, and 160° F. for 7 minutes. The mold is removed from the solution, rinsed with water and allowed to air dry. Upon visual inspection the contaminants were observed to be removed in the 160° F. for 7 minute process, although at 140° F. the polymer was removed when exposed for a long time period.

EXAMPLES 6–9

Polymer physically removed from optical molds and tooling used in the optical lens manufacturing process is selected for determination of dissolution in the nitrogenated cleaning solution. The polymer contamination contained a mix of a diethylene glycol bisallyl carbonate (DEGBAC) based monomer and a polyurethane based monomer that contains a sulfur molecule (thioether). The nitrogen based solutions tested were commercially available quaternary ammonium hydroxide materials in aqueous solutions (Sachem, Inc.). The polymer was added at an approximate 4% addition by weight to the cleaning solution at 160° F. and allowed to dissolve for a period of 5 minutes. At the end of the 5 minute, period visual observations were made to judge the percent dissolution. Below are the results of the test:

| Material | Commercial Concentration | Percent Dissolution |
|---|---|---|
| Tetramethylammonium Hydroxide | 25% | 100% |
| Tetraethylammonium Hydroxide | 35% | 90% |
| Tetrapropylammonium Hydroxide | 20% | 90% |
| Tetrabutylammonium Hydroxide | 55% | 95% |

EXAMPLES 10–19

Polymer physically removed from optical molds and tooling used in the optical lens manufacturing process is selected for determination of dissolution in the nitrogenated cleaning solution and compared to previously run examples listed above. The polymer contamination contained a mix of a diethylene glycol bisallyl carbonate (DEGBAC) based monomer and a polyurethane based monomer that contains a sulfur molecule (thioether). The nitrogen based solutions tested were commercially available nitrogen containing compounds from various sources, some of which were aqueous solutions. The polymer was added at an approximate 4% addition by weight to the cleaning solution at 160° F. and allowed to dissolve for a period of 5 minutes. At the end of the 5 minute period visual observations were made to judge the dissolution. Below are the results of the test:

| Material | Commercial Concentration | Observed Dissolution |
|---|---|---|
| Tetramethylammonium Hydroxide | 25% | Complete |
| 2-methylpentamethylene diamine | 100% | Partial to full |
| Ammonia | 30% | Very slight |
| Trimethyl-2-hydroxyethyl ammonium hydroxide (choline) | 45% | Partial to full |
| n-isopropylhydroxyamine | 100% | Partial |
| Piperidine | 99% | Slight |
| 1-Piperidineethanol | 100% | Very Slight |
| Monoethanolamine | 100% | Partial to full |
| N-methyl pyrrolidone | 100% | None |
| N-ethyl pyrrolidone | 100% | None |

EXAMPLES 20–23

Polymer physically removed from optical molds and tooling used in the optical lens manufacturing process is selected for determination of dissolution in water diluted solutions of tetramethylammonium hydroxide (TMAH). The polymer contamination contained a mix of a diethylene glycol bisallyl carbonate (DEGBAC) based monomer and a polyurethane based monomer that contains a sulfur molecule (thioether). The polymer was added at an approximate 4% addition by weight to the cleaning solution at 160° F. and allowed to dissolve for a period of 5 minutes. At the end of the 5 minute period visual observations were made to judge the dissolution. Below are the results of the test:

| Tetramethylammonium Hydroxide Diluted TMAH | | |
|---|---|---|
| Commercial Conc./Dilution | Concentration | Observed Dissolution |
| 25%/100% TMAH Solution | 25% | Complete |
| 25%/75% TMAH Solution | 18.8% | Partial to full |

-continued

Tetramethylammonium Hydroxide Diluted TMAH

| Commercial Conc./Dilution | Concentration | Observed Dissolution |
|---|---|---|
| 25%/50% TMAH Solution | 12.5% | Slight |
| 25%/25% TMAH Solution | 6.3% | Slight to None |

EXAMPLES 24–37

Using various lens molds and polymer physically removed from optical molds and tooling used in the optical lens manufacturing process, tests were conducted on a number of mixtures representative of the art disclosed in the patent. The conditions mixtures, are listed below along with the results of the tests:

| | | |
|---|---|---|
| 24) Mixture: | 34% | Monoethanolamine |
| | 40% | Tetrahydrofurfuryl Alcohol |
| | 20% | Water |
| | 1% | Sodium Hydroxide |
| | 5% | Surfactant |
| Conditions: | | 160° F. for 6 minutes, no agitation |
| Results: | | Slight cleaning of polymer from molds. |
| 25) Mixture: | 44% | Monoethanolamine |
| | 40% | Tetrahydrofurfuryl Alcohol |
| | 10% | Water |
| | 1% | Sodium Hydroxide |
| | 5% | Surfactant |
| Conditions: | | 160° F. for 7 minutes, no agitation |
| Results: | 99% | cleaning of polymer from molds. |
| 26) Mixture: | 10.5% | Hexamethylenediamine (Commercial 70% Solution) |
| | 40% | Tetrahydrofurfuryl Alcohol |
| | 4.5% | Water |
| | 5% | Surfactant |
| Conditions: | | 160° F. for minutes, no agitation |
| Results: | | Very slight cleaning of polymer from molds. |
| 27) Mixture: | 100% | 1,3 Pentanediamine |
| Conditions: | | 160° F. for 5 minutes, no agitation |
| Results: | | Removed polymer from molds. |
| 28) Mixture: | 15% | 1,3 Pentanediamine |
| | 85% | Tetrahydrofurfuryl Alcohol |
| Conditions: | | 160° F. for 5 minutes, no agitation |
| Results: | | Slight cleaning of polymer from molds. |
| 29) Mixture: | 0.5% | Trimethyl-2-hydroxyethyl ammonium hydroxide (Choline commercial 45% solution) |
| | 44% | Monoethanolamine |
| | 40% | Tetrahydrofurfuryl Alcohol |
| | 10.5% | Water |
| | 5% | Surfactant |
| Conditions: | | 160° F. for 6 minutes, no agitation |
| Results: | | Fair removal of polymer from molds. |
| 30) Mixture: | 15% | 2-Methylpentamethylene diamine |
| | 85% | N-Methyl Pyrrolidone |
| Conditions: | | 150° F. (ca. 65° C.) for 5 minutes, no agitation |
| Results: | | Fair to good cleaning of polymer from molds. |
| 31) Mixture: | 3.8% | Tetramethylammonium hydroxide (25% solution) |
| | 27.5% | Tetrahydrofurfuryl Alcohol |
| | 68.7% | Water |
| Conditions: | | 160° F. for 6 minutes, no agitation |
| Results: | | Fair dissolution of polymer in beaker. |
| 32) Mixture: | 15% | 2-Methylpentamethylene diamine |
| | 45% | Monoethanolamine |
| | 40% | Amyl Alcohol |
| Conditions: | | 150° F. for 5 minutes, no agitation |
| Results: | | Fair to good dissolution of polymer in beaker. |
| 33) Mixture: | 15% | Ethylenediamine |
| | 45% | Monoethanolamine |
| | 40% | Amyl Alcohol |
| Conditions: | | 150° F. for 5 minutes, no agitation |
| Results: | | Fair to good dissolution of polymer in beaker. |
| 34) Mixture: | 10% | Ethylenediamine |
| | 30% | Monoethanolamine |
| | 35% | Amyl Alcohol |
| | 25% | Water |
| Conditions: | | 150° F. for 5 minutes, no agitation |
| Results: | | Fair dissolution of polymer in beaker. |
| 35) Mixture: | 15% | Ethylenediamine |
| | 45% | Monoethanolamine |
| | 40% | Tetrahydrofurfuryl Alcohol |
| Conditions: | | 150° F. for 3 minutes, no agitation |
| Results: | | Fair to good dissolution of polymer in beaker. |
| 36) Mixture: | 10.5% | Hexamethylenediamine (Commercial 70% Solution) |
| | 4.5% | Water |
| | 84% | Tetrahydrofurfuryl Alcohol |
| | 1% | Surfactant |
| Conditions: | | 150° F. for 3 minutes, no agitation |
| Results: | | Fair to cleaning of polymer from mold. |
| 37) Mixture: | 21% | Hexamethylenediamine (Commercial 70% Solution) |
| | 28% | Monoethanolamine |
| | 9% | Water |
| | 41% | Tetrahydrofurfuryl Alcohol |
| | 1% | Surfactant |
| Conditions: | | 150° F. for 10 minutes, no agitation |
| Results: | 95% | removal of polymer from mold. |

Although the invention has been described and illustrated in detail, it is to be clearly understood that the same is by way of illustration and example, and is not to be taken as a limitation. The spirit and scope of the present invention are to be limited only by the terms of the appended claims. One skilled in the art can make many adjustments, changes, or modifications to the components of the compositions used to clean polymers and resins without departing from the scope of this invention. And, for example, more than one combination of the cleaning compositions can be used sequentially to clean an article or part, optionally employing different types of methods for the composition to contact the article or part, and optionally under differing conditions. In addition, the above description enables the skilled artisan to make and use the invention of the following claims.

What is claimed is:

1. A composition for cleaning polymers or resins from a surface, consisting essentially of:

(A) an effective amount of tetrahydrofurfuryl alcohol and tetramethylammonium hydroxide for cleaning said polymers or resins from a surface (B) water;

(C) at least one member of the group consisting of esters, ethers, additional cyclic ethers, ketones, alkanes, terpenes, dibasic esters, pyrrolidones, low or non-ozone depleting chlorinated or chlorinated/fluorinated hydrocarbons, and mixtures thereof; and (D) optionally, at least one memmber of the group consisting of buffers, surfactants, water-soluble glycol ethers, additional water-soluble alcohols, and inorganic hydroxides;

said composition having a pH of 7 or greater.

2. The composition as claimed in claim 1, wherein the alcohol is selected from the group consisting of methanol, ethanol, propanol, isopropanol, butanol, 2-butanol, tert butyl alcohol, 1-pentanol, 2-pentanol, 3-pentanol, methyl propanol, methyl butanol, trifluoroethanol, allyl alcohol, 1-hexanol, 2-hexanol, 3-hexanol, 2-ethyl hexanol, 1-pentanol, 1-octanol, 1-decanol, 1-dodecanol, cyclohexanol, cyclopentanol, benzyl alcohol, furfuryl alcohol, bis-hydroxymethyl tetrahydrofuran, ethylene glycol, propylene glycol, and butylene glycol, and mixtures thereof.

3. The composition of claim 1, wherein the inorganic hydroxide is selected from the group consisting of sodium, potassium, magnesium, calcium and lithium hydroxide, and mixtures thereof.

4. The composition of claim 1, wherein said ester is of the formula $R_1$—COO—$R_2$, where $R_1$ is $C_1$–$C_{20}$ alkyl, $C_5$–$C_6$ cycloalkyl, benzyl, furanyl or tetrahydrofuranyl, and $R_2$ is $C_1$–$C_8$ alkyl, $C_5$–$C_6$ cycloalkyl, benzyl, phenyl, furanyl or tetrahydrofuranyl.

5. The composition of claim 4, wherein the ester is selected from the group consisting of methyl formate, methyl acetate, methyl propionate, methyl butyrate, ethyl formate, ethyl acetate, ethyl propionate, ethyl butyrate, propyl formate, propyl acetate, propyl propionate, propyl butyrate, butyl formate, butyl acetate, butyl propionate, butyl butyrate, amyl acetate, methyl soyate, isopropyl myristate, propyl myristate, butyl myristate, and mixtures thereof.

6. The composition of claim 1, wherein said ether is of the formula $R_3$—O—$R_4$, where $R_3$ is $C_1$–$C_{10}$ alkyl or alkynl, $C_5$–$C_6$ cycloalkyl, benzyl, phenyl, furanyl or tetrahydrofuranyl, $R_4$ is $C_1$–$C_{10}$ alkyl or alkynyl, $C_5$–$C_6$ cycloalkyl, benzyl, phenyl, furanyl or tetrahydrofuranyl.

7. The composition of claim 6, wherein the ether compound is selected from the group consisting of ethyl ether, methyl ether, propyl ether, isopropyl ether, butyl ether, methyl tert butyl ether, ethyl tert butyl ether, vinyl ether, allyl ether, anisole, and mixtures thereof.

8. The composition of claim 1, wherein the cyclic ether is selected from the group consisting of 1,4 dioxane, 1,3 dioxolane, tetrahydrofuran (THF), methyl THF, dimethyl THF and tetrahydropyran (THP), methyl THP, dimethyl THP, ethylene oxide, propylene oxide, butylene oxide, amyl oxide, isoamyl oxide, and mixtures thereof.

9. The composition of claim 1, wherein said ketone is of the formula $R_5$—C═O—$R_6$, where $R_5$ is $C_1$–$C_{10}$ alkyl, $C_5$–$C_6$ cycloalkyl, benzyl, furanyl or tetrahydrofuranyl, $R_5$ is $C_1$–$C_{10}$ alkyl, $C_5$–$C_6$ cycloalkyl, benzyl, phenyl, furanyl or tetrahydrofuranyl.

10. The composition of claim 9, wherein the ketone is selected from the group consisting of acetone, methyl ethyl ketone, 2-pentanone, 3-pentanone, 2-hexanone, 3-hexanone, methyl isobutyl ketone, and mixtures thereof.

11. The composition of claim 1, wherein said alkane is of the formula: $C_n H_{n+2}$, where n=1–20, or $C_4$–$C_{20}$ cycloalkanes.

12. The composition of claim 11, wherein the alkane is selected from the group consisting of methane, ethane, propane, butane, methyl propane, pentane, isopentane, methyl butane, cyclopentane, hexane, cyclohexane, dimethylcyclohexane, ethylcyclohexane, isohexane, heptane, methyl pentane, dimethyl butane, octane, nonane, decane, and mixtures thereof.

13. The composition of claim 1, wherein said terpene has a repeating unit of the formula:

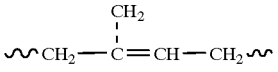

where the compound may be cyclic or multicyclic.

14. The composition of claim 13, where the terpene is selected from the group consisting of d-limonene, pinene, terpineol, turpentine, dipentene, and mixtures thereof.

15. The composition of claim 1, wherein said dibasic ester is of the formula: $R_1$—COO—$R_8$—COO—$R_9$, where $R_7$ is $C_1$–$C_{20}$ alkyl, $C_5$–$C_6$ cycloalkyl, benzyl, furanyl or tetrahydrofuranyl, $R_8$ is $C_1$–$C_{20}$ alkyl, $C_5$–$C_6$ cycloalkyl, benzyl, phenyl, furanyl or tetrahydrofuranyl, $R_9$ is $C_1$–$C_{20}$ alkyl, $C_5$–$C_6$ cycloalkyl, benzyl, furanyl or tetrahydrofuranyl.

16. The composition of claim 15, wherein the dibasic ester is selected from the group consisting of dimethyl oxalate, dimethyl malonate, dimethyl succinate, dimethyl glutarate, dimethyl adipate, methyl ethyl succinate, methyl ethyl adipate, diethyl succinate, diethyl adipate, and mixtures thereof.

17. The composition of claim 1, wherein said glycol ether is of the formula $R_{10}$—O—$R_{11}$—O—$R_{12}$, where $R_{10}$ is $C_2$–$C_{20}$ alkyl, $C_5$–$C_6$ cycloalkyl, benzyl, furanyl or tetrahydrofuranyl, $R_{11}$ is $C_1$–$C_{20}$ alkylene, $C_5$–$C_6$ cycloalkylene, benzylidene, phenylene, furyl or tetrahydrofuryl, and $R_{12}$ is hydrogen or an alcohol of the formula $C_xH_y(OH)_z$, where x=1 to 18, y<2x+2, and z=1 or 2.

18. The composition of claim 17, wherein the glycol ether is selected from the group consisting of ethylene glycol methyl ether, diethylene glycol methyl ether, ethylene glycol ethyl ether, diethylene glycol ethyl ether, ethylene glycol propyl ether, diethylene glycol propyl ether, ethylene glycol butyl ether, diethylene glycol butyl ether, methyl methoxybutanol, propylene glycol methyl ether, dipropylene glycol, dipropylene glycol methyl ether, propylene glycol propyl ether, dipropylene glycol propyl ether, propylene glycol butyl ether, dipropylene glycol butyl ether, and mixtures thereof.

19. The composition of claim 1, wherein said pyrrolidone has a substitution at the N position of the pyrrolidone ring of hydrogen, $C_1$ to $C_6$ alkyl, or $C_1$ to $C_6$ alkanol.

20. The composition of claim 19, wherein the pyrrolidone is selected from the group consisting of pyrrolidone, N-methyl pyrrolidone, N-ethyl pyrrolidone, N-propyl pyrrolidone, N-hydroxymethyl pyrrolidone, N-hydroxyethyl pyrrolidone, and N-hexyl pyrrolidone, and mixtures thereof.

21. The composition of claim 1, wherein said chlorinated hydrocarbon is of the formula: $R_{13}$—$Cl_x$, where $R_{13}$ is $C_1$–$C_{20}$ alkyl, $C_1$–$C_{20}$ alkenyl, $C_1$–$C_{10}$ cycloalkyl, $C_2$–$C_{20}$ alkenyl benzyl, or phenyl, and X>1, and the Ozone Depletion Potential (ODP) of the compound is less than about 0.15.

22. The composition of claim 21, wherein the chlorinated hydrocarbon is selected from the group consisting of methyl chloride, methylene chloride, ethyl chloride, dichloro ethane, dichloro ethylene, propyl chloride, isopropyl chloride, propyl dichloride, butyl chloride, isobutyl chloride, sec-butyl chloride, tert-butyl chloride, pentyl chloride, hexyl chloride, and mixtures thereof.

23. The composition of claim 1, further including at least one buffer.

24. The composition of claim 23, wherein the buffer is selected from the group consisting of acids, bases and their salts, inorganic mineral acids and their salts, weak organic acids having a pKa of greater than 2 and their salts, ammonium salts, acetic acid, ammonium acetate, boric acid, citric acid potassium biphthalate, mixtures of ammonium chloride and ammonium acetate, and mixtures of acetic acid and ammonia and another amine.

25. The composition of claim 1, further including a surfactant.

26. The composition of claim 1, further including a perfume.

27. The composition of claim 1, further including a corrosion inhibitor.

* * * * *